United States Patent [19]

Szpur

[11] 4,138,713

[45] * Feb. 6, 1979

[54] LIGHT FIXTURE

[75] Inventor: Roman Szpur, Dayton, Ohio

[73] Assignee: Panabeam Corp., Dayton, Ohio

[ * ] Notice: The portion of the term of this patent subsequent to May 3, 1994, has been disclaimed.

[21] Appl. No.: 786,588

[22] Filed: Apr. 11, 1977

Related U.S. Application Data

[63] Continuation-in-part of Ser. No. 618,136, Sep. 30, 1975, Pat. No. 4,021,660.

[51] Int. Cl.[2] ..... F21V 29/00; F21V 31/02; F21V 7/12

[52] U.S. Cl. ..... 362/218; 362/267; 362/277; 362/370; 362/373

[58] Field of Search ..... 362/158, 218, 263, 267, 362/269, 282, 297, 306, 373, 370, 318, 320, 363

[56] References Cited

U.S. PATENT DOCUMENTS

| | | | |
|---|---|---|---|
| 2,907,870 | 10/1959 | Calmes | 362/267 X |
| 3,021,422 | 2/1962 | Oglier et al. | 362/218 |
| 3,569,692 | 3/1971 | Johnson et al. | 362/267 |
| 3,609,337 | 9/1971 | Adra et al. | 362/306 |
| 3,610,915 | 10/1971 | Moore | 362/282 |

*Primary Examiner*—Harry E. Moose, Jr.

*Assistant Examiner*—Peter S. Wong

*Attorney, Agent, or Firm*—Jacox & Meckstroth

[57] ABSTRACT

A rectangular reflector sheet of relatively stiff aluminum is curved into the general shape of an elongated parabola and is inserted into a cylindrical transparent glass tube so that the edge portions of the sheet press outwardly against the tube. A set of end closure caps or members are clamped against the ends of the tube by a pair of tie bolts which extend axially between the reflector sheet and the inner surface of the tube. Each of the end closure members is provided with an annular groove which receives an annular resilient gasket and the corresponding end of the tube to form a fluid-tight seal between the tube and the closure member. One of the end closure members has an eccentrically located hollow hub portion which supports a socket for receiving the socket end of an elongated lamp element extending along the offset focal axis of the curved reflector sheet. The other end closure member has a similar eccentric hub portion which supports a member for conducting heat from the lamp element as well as for supporting the opposite end of the lamp element. Both of the end closure members also support corresponding end reflector panels which project cantileveredly into the tube, and the closure members are provided with outwardly projecting ribs for radiating heat from the light fixture.

15 Claims, 6 Drawing Figures

LIGHT FIXTURE

RELATED APPLICATION

This application is a continuation-in-part of U.S. Pat. application Ser. No. 618,136, filed Sept. 30, 1975, now U.S. Pat. No. 4,021,660.

BACKGROUND OF THE INVENTION

In the art of commercial and industrial lighting fixtures such as disclosed, for example, in U.S. Pat. Nos. 3,246,135, 3,254,205, 3,609,337 and 3,610,915, it is desirable to provide for tightly sealing the fixture housing which receives the lamp element and the reflectors in order to avoid the seepage of dust, dirt and moisture into the housing and onto the lamp element and reflectors. As shown in above U.S. Pat. Nos. 3,246,135 and 3,609,337, one form of seal is provided by positioning a resilient gasket between the frame-like surface on the cast metal housing and the covering glass lens element which is retained by a surrounding cast metal frame. Due to the cast construction of the metal housings and frames and the difficulty of obtaining precisely parallel surfaces between each housing and frame, it is frequently difficult to obtain a positive, fluid-tight and dependable seal which prevents the seepage of dust and moisture into the lamp and reflector chamber.

It has also been found desirable to provide a high intensity commercial and industrial light fixture with means for conveniently changing the projected angle of the light from the fixture in order to change the area of illumination or to concentrate the projected light in a specified area. Furthermore, it has been found desirable to provide for conveniently constructing the light fixture in different sizes for different intensities of illumination and thus be able to accommodate electric lamp elements of different sizes or lengths.

It is apparent after carefully reviewing the disclosures of the above patents and of other prior art lighting fixtures such as disclosed in U.S. Pat. Nos. 1,873,392, 2,849,598 and 3,679,886, that none of the light fixtures which have been either constructed or proposed, provide all of the desirable features mentioned above.

SUMMARY OF THE INVENTION

The present invention is directed to an improved electrical light fixture which is ideally suited for use in an environment where the fixture is exposed to high moisture and/or a high concentration of dust particles, and which is simple and inexpensive in construction in addition to having high rigidity and durability. The light fixture of the invention also provides for conveniently changing the angle through which light is projected and thereby provides for conveniently changing the area of illumination. The light fixture further provides for thermal expansion and contraction of the assembled components in response to energizing and de-energizing the electric lamp element, and is adapted to be easily constructed in different sizes for accommodating lamp elements of different wattage such as, for example, a lamp element of 400 watts and one of 1,000 watts.

In accordance with the illustrated embodiments, the above desirable features and advantages are generally provided by a lamp fixture which includes an elongated cylindrical tube of high strength glass. A flat rectangular reflector sheet of relatively stiff metal is curved into the general shape of a parabola, and opposite edge portions of the sheet are bent outwardly so that when the curved sheet is inserted into the tube, the opposite edge portions and an intermediate center portion are urged outwardly against the inner surface of the tube. A set of end caps or closure members are provided with annular grooves and gaskets for receiving the opposite end portions of the glass tube, and the closure members are clamped against the ends of the tube by a pair of tie rods which extend axially between the inner surface of the tube and the reflector sheet.

The closure members have corresponding eccentrically located and outwardly projecting hollow hub portions. One of the hub portions receives a socket for supporting the threaded end of an electric lamp element, and the hub portion of the other end closure member supports a spring biased member which engages the opposite end of the lamp element for conducting heat from the lamp element and for aiding in its support. A U-shaped support bracket is clamped to the hub portions and provides for adjustably rotating the light fixture. The closure members also support corresponding end reflector panels which project into the glass tube, and spaced heat radiating ribs are formed as integral parts of the end closure members.

Other features and advantages of the invention will be apparent from the following description, the accompanying drawings and the appended claims.

DESCRIPTION OF THE PREFERRED EMBODIMENTS

Figure 1:
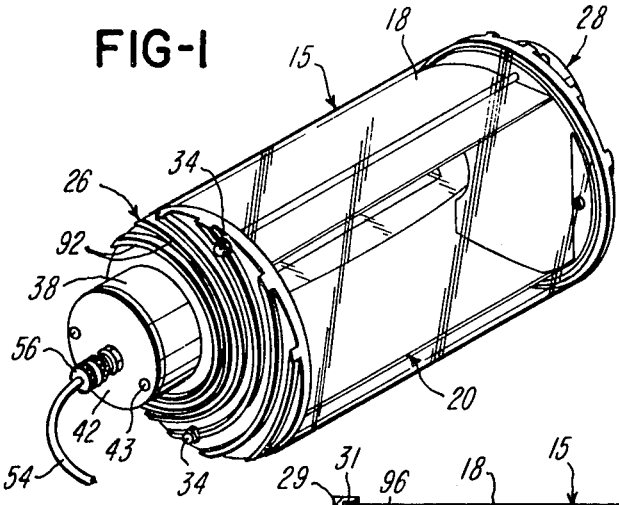
FIG. 1 is a perspective view of an electric light fixture constructed in accordance with the invention.
Figure 3:
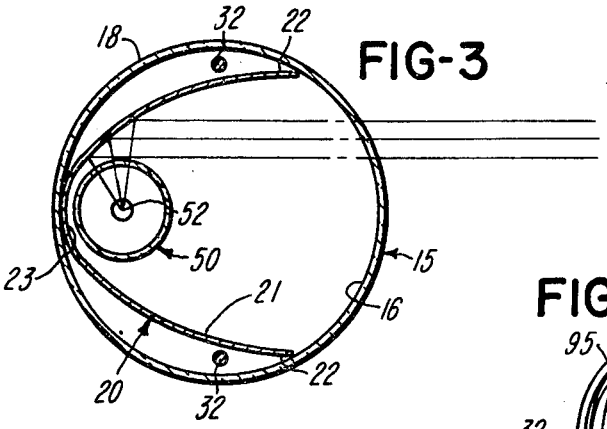
FIG. 3 is a radial section taken generally on the line 3—3 of FIG. 2.
Figure 4:
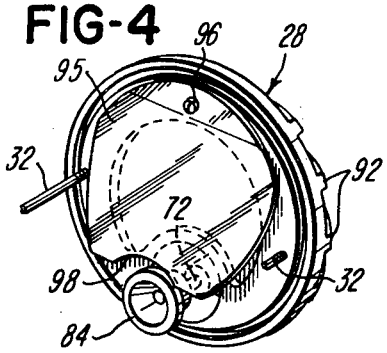
FIG. 4 is a perspective view of the exploded end closure member shown in FIG. 2.

The light fixture illustrated in FIG. 1 includes an elongated cylindrical tube 15 of high strength or tempered transparent glass and which has a smooth cylindrical inner surface 16 and a smooth cylindrical outer surface 18. A reflector member or sheet 20 consists of a rectangular panel or sheet of aluminum having a highly polished reflective surface 21. Prior to being inserted into the tube 15, the relatively stiff reflector panel or sheet 20 is stored as a flat sheet. When a light fixture is assembled, the sheet is trimmed to a predetermined length according to the angle of light projection and the desired area of illumination. The reflector sheet is then manually bent or curved into a generally parabolic configuration (FIG. 3) and is inserted into the tube 15 so that the opposite edge or end portions 22 and an intermediate center portion 23 of the sheet are urged outwardly against the inner surface 16 of the tube 15 due to the inherent spring characteristic of the relatively stiff aluminum reflector sheet 20. This spring characteristic assures that the reflector sheet 20 remains in position, as illustrated in FIG. 3, but permits the edge portions 22 of the sheet of shift slightly relative to the inner surface 16 of the tube 15 in response to thermal expansion and contraction of the reflector sheet as its temperature changes.

Figure 2:
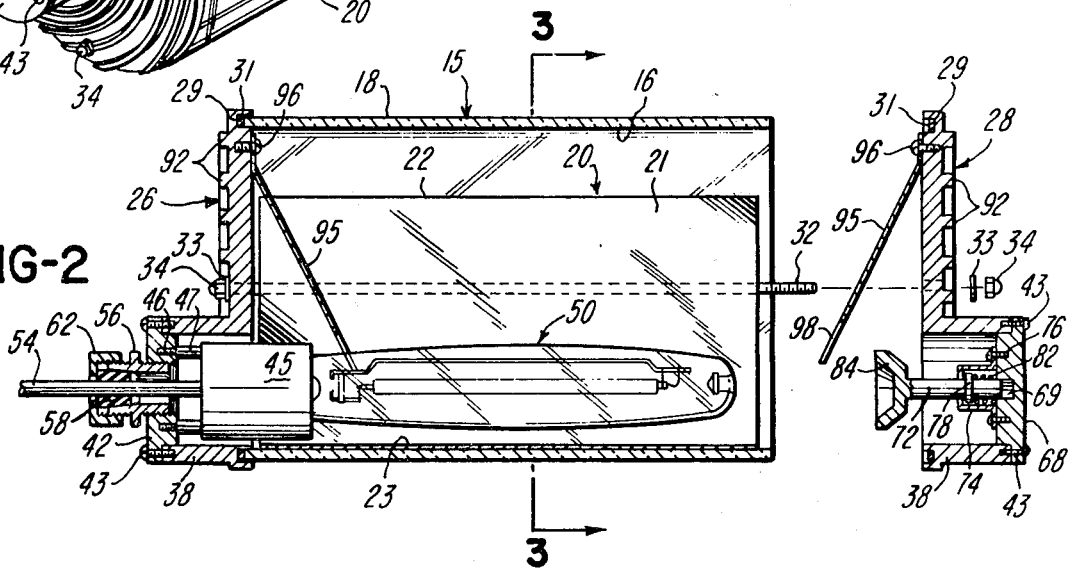
FIG. 2 is an axial section of the light fixture shown in FIG. 1 and with an end closure member shown in an exploded position.

As shown in FIG. 2, the axial length of the reflector sheet 20 is slightly less than the axial length of the tube 15, and the opposite end portions of the tube 15 receive a corresponding set of end closure members 26 and 28 which are preferably cast from aluminum. Each of the end closure members 26 and 28 includes an annular groove 29 which receives the corresponding end portion of the tube 15 and which confines an annular resilient rubber-like gasket 31 for engaging the corresponding end surface of the tube 15.

A pair of parallel spaced tie bolts 32 extend axially within the tube 15 between the reflector sheet 20 and the inner surface 16 of the tube and are disposed in diametrically opposite positions within the tube 15. The opposite end portions of each tie rod 32 are threaded and extend through corresponding holes within the end closure members 26 and 28, and each end portion receives a washer 33 and a cap-nut 34. When the nuts 34 are tightened, the end closure members 26 and 28 are drawn towards the ends of the tube 15 in order to compress and deform the gaskets 31 and to form a fluid-tight seal between the tube 15 and each end closure member.

Each of the end closure members 26 and 28 includes an outwardly projecting hollow hub portion 38 which is offset or positioned eccentrically relative to the axis of the tube 15. The tubular hub portion 38 of the end closure member 26 has an outer end which is closed by a circular plug-like end wall 42 secured by a set of screws 43.

A porcelain lamp socket 45 is supported within the tubular portion 38 of the end closure member 26 by a set of screws 46 which extend through corresponding spacer tubes 47. The lamp socket 45 receives the threaded base of an elongated lamp element 50 which may be of the sodium high vapor pressure type such as the lamp element marketed by the General Electric Company under the trademark Lucalox. The lamp element 50 may also be of other types such as quartz-iodine or xenon lamp.

As shown in FIG. 3, the axis of the lamp element 50 is substantially coincedent or common with the axis of the tubular hub portions 38 of the end closure members 26 and 28 and is also substantially coincedent or common with the focal axis 52 of the curved reflector sheet 20. Electrical power is supplied through the lamp socket 45 to the lamp element 50 by a power cord 54 which is connected to a suitable transformer or ballast (not shown). The cord 54 extends through a tubular fitting 56 threaded into a center opening within the end wall 42 of the tubular hub portion 38. The fitting 56 has a frusto-conical internal end surface which receives a mating surface on a resilient annular sealing member 58. The sealing member 58 is retained by an annular cap 62 which is threadably connected to the fitting 56. Thus when the cap 62 is tightened, the sealing member 58 is compressed firmly between the outer surface of the power supply cord 54 and the inner surface of the fitting 56 to form a positive fluid-tight seal.

The tubular or hollow hub portion 38 of the opposite enclosure cap or member 28 includes a removable outer end wall 68 which is also secured by a set of screws 43. The end wall 68 includes a centrally located blind cylindrical bore 69 which slidably receives one end portion of a cylindrical aluminum rod 72. An intermediate portion of the rod 72 is supported by a cup-shaped sheet metal housing 74 having a bottom flange portion secured to the end wall 68 by a set of screws 76. The housing 74 surrounds an outwardly projecting circumferential flange 78 formed on the rod 72 and encloses a compression coil spring 82 which extends between the flange 78 and the inner surface of the wall 68.

The outer end portion of the rod 72 supports an aluminum cup member 84 which is adapted to engage the outer corresponding end portion of the lamp element 50 when the end closure member 28 is mounted on the corresponding end of the tube 15. The spring loaded cup member 84 serves not only to position and support the outer end portion of the lamp element 50 but also cooperates to conduct heat from the lamp element 50 through the rod 72 and the housing 74 to the end wall 68 of the hub portion 38. The cup member 84 may be lined with a thin layer of asbestos material to provide a cushion support for the outer end of the lamp element 50.

As shown in FIGS. 1 and 2, both of the end closure members 26 and 28 are provided with a series of outwardly projecting arcuate fins or ribs 92 which extend concentrically with the corresponding hollow hub portion 38. The integral ribs 92 of the aluminum end closure members 26 and 28 cooperate to aid in dissipating heat which is generated when the lamp element 50 is energized.

The end closure members 26 and 28 also support a corresponding set or pair of end reflector sheets or members 95 which are formed from the same relatively stiff aluminum sheet material used to form the reflector sheet 20. Each of the end reflector members 95 includes an edge portion which is secured to the corresponding end closure member by a screw 96. The remaining or major portion of the reflector member projects in a cantilevered manner from the corresponding end closure member into the corresponding end portion of the tube 15 and curved reflector sheet 20. The inner end portion of each reflector sheet 95 has an arcuate recess 98 for receiving the corresponding end portion of the lamp element 50.

Figure 5:
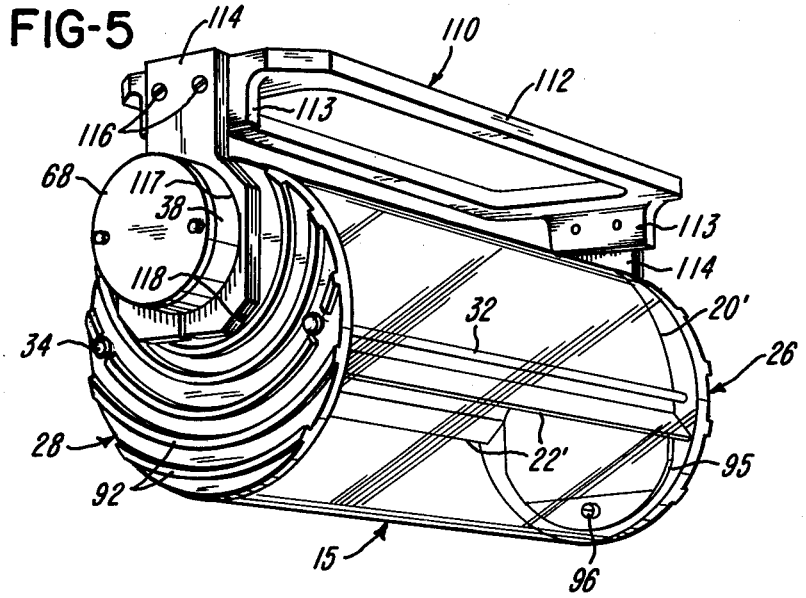
FIG. 5 is a perspective view similar to FIG. 1 and showing a light fixture constructed in accordance with a modification of the invention.
Figure 6:
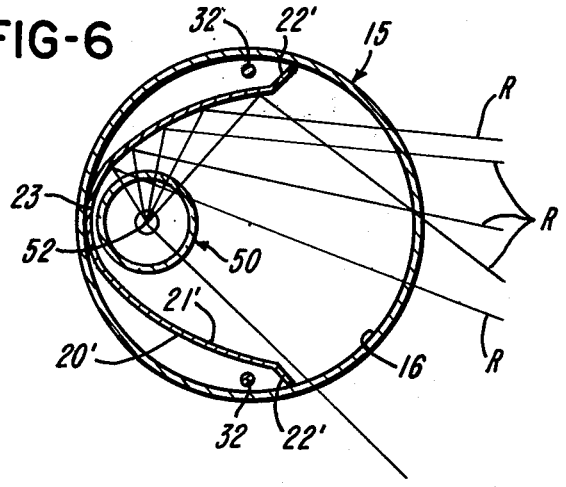
FIG. 6 is a radial section, similar to FIG. 3, of the light fixture embodiment shown in FIG. 5.

FIGS. 5 and 6 illustrate a light fixture which is constructed substantially the same as the light fixture described above in connection with FIGS. 1–4, but which incorporates a modification. Thus since most of the components of the light fixture shown in FIGS. 5 and 6 are identical to the corresponding components of the light fixture shown in FIGS. 1–4, the same reference numbers are used to identify the identical components.

As mentioned above, the reflector panel or sheet 20 shown in FIGS. 1–3, is trimmed to length so that the opposite edge portions 22 engage the inner surface of the tube 15 at locations which provide the desired reflected lighting pattern. In the modification shown in FIGS. 5 and 6, the opposite end or edge portions 22' are bent outwardly from the inner reflective surface 21' of the sheet metal reflector panel 20'. The degree or angle of the bend is selected to produce the desired lighting pattern, as illustrated by the non-parallel reflected light rays R. Thus to produce a predetermined lighting pattern, the opposite edge portions 22' may be formed or bent at different angles or only one of the edge portions may be bent while the opposite edge portion remains the same as each of the edge portions 22 of the reflector sheet 20 shown in FIG. 3.

The axially aligned hub portions 38 on the end closure members 26 and 28, provide for conveniently supporting the light fixture and for rotatably adjusting the fixture. Thus as shown in FIG. 5, the light fixture is supported by a generally U-shaped metal support bracket 110 which is preferably cast of an aluminum alloy material. The support bracket 110 includes a rectangular mounting frame 112 having opposite end flanges 113. A pair of arms 114 are secured to the flanges 113 by corresponding sets of screws 116, and each of the arms 114 includes a bifurcated or split annular portion defining a cylindrical bore 117 which receives the corresponding hub portion 38. A clamping screw 118 connects the outer end portions of each arm 114 and provides for firmly clamping the end portion on the corresponding hub portion 38 after the light fixture is rotated on the axis of the hub portions to the desired position relative to the support bracket 110.

From the drawings and the above description, it is apparent that a light fixture constructed in accordance with the present invention, provides desirable features and advantages. For example, the light fixture is not only durable in construction but is also simple and economical to construct. As mentioned above, the reflector sheet 20 is adapted to be stored as a flat rectangular sheet and is simply trimmed along one edge according to the desired angle of light projection. Thus as illustrated in FIG. 3, the projected light rays are substantially parallel. However, by simply trimming off an edge portion 22 of the flat sheet or bending the edge portion 22' before the sheet is curved and inserted into the glass tube 15, it is apparent that the end portions 22 or 22' of the sheet will move either outwardly or inwardly within the tube to provide a change in the pattern of the reflected light rays. This flexibility permits one light fixture to be quickly and inexpensively modified to change the area of illumination.

The light fixture is also adapted to be conveniently constructed to accommodate lamp elements 50 of different wattage and corresponding length. Thus when it is desired to use a longer lamp element having a greater wattage, it is only necessary to increase the length of the tube 15 and the corresponding length of the tie rods 32. This flexibility is highly desirable in order to accommodate different types of lamp elements.

The generally cylindrical configuration of the glass tube 15 is also desirable in that it is self-cleaning when exposed to wind and rain. However, while a clear transparent glass tube 15 is illustrated in the drawing, it is apparent that the tube may be provided with a filter. The glass tube may also be provided with outwardly projecting integral ribs or the tube may be partially surrounded with a metal sleeve having outwardly projecting integral ribs for dissipating heat, for example, when lamp elements of high wattage are used within the tube. It is also apparent that either or both of the tubular hub portions 38 of the end closure members 26 and 28 may be provided with an outer end wall coupled by a quick release fastener, such as a bayonet type connection, to facilitate quick removal and interchangement of the lamp element 50. Either one or both of the hub portions 38 also provide for rigidly supporting the light fixture and for conveniently adjusting the position of the fixture.

While the forms of light fixture and method herein described constitute preferred embodiments of the invention, it is to be understood that the invention is not limited to these precise forms of fixture and method, and that changes may be made therein without departing from the scope and spirit of the invention as defined in the appended claims.

I claim:

1. An improved light fixture adapted for use in an environment of high moisture and/or high dust particles, comprising an elongated transparent tube having opposite end portions and a center axis, a set of end closure members mounted on corresponding said end portions of said tube, means for positively securing said end closure members to the corresponding said end portions of said tube, a generally U-shaped reflector panel disposed within said tube and having an inner reflecting surface, means located on at least one of said end closure members eccentrically of said center axis and supporting an elongated lamp element with an axis spaced generally parallel to said center axis of said tube and between the inner surface of said tube and said center axis of said tube, and said reflector panel extends between said lamp element and the inner surface of said tube.

2. A light fixture as defined in claim 1 wherein said reflector panel comprises a generally rectangular sheet of metal, and said panel has at least one bent edge portion projecting outwardly from said inner reflecting surface of said panel.

3. A light fixture as defined in claim 2 wherein said panel has opposite bent edge portions projecting outwardly and being restrained by the inner surface of said tube, and said panel is bendable to facilitate adjustment of said opposite edge portions.

4. A light fixture as defined in claim 2 wherein said reflector panel comprises a curved generally rectangular sheet of relatively stiff metal having an inherent spring characteristic causing said edge portion of said reflector sheet to be urged outwardly towards the inner surface of said tube.

5. A light fixture as defined in claim 1 including a spring biased metal plunger mounted on the other said end closure member, and metal cup means mounted on said plunger for supporting said lamp element and engaging said lamp element for conducting heat from said lamp element to said other end closure member.

6. A light fixture as defined in claim 1 wherein said one end closure member includes an outwardly projecting generally cylindrical hollow support hub having an axis disposed generally parallel and eccentrically to said center axis of said tube, means within said support hub for supporting one end of said lamp element, and a support bracket including a releasable clamp portion surrounding and supporting said hub for rotatable adjustment.

7. A light fixture as defined in claim 6 wherein said hub of said one end closure member includes a removable outer end wall to provide for convenient access to said lamp element, and said hub defines an opening of sufficient size for removing said lamp element axially from said tube through said opening.

8. A light fixture as defined in claim 1 wherein said means for securing said end closure members to said corresponding end portions of said tube comprise a set of parallel spaced tie rods extending axially between said reflector panel and the inner surface of said tube.

9. A light fixture as defined in claim 1 wherein said end closure members each includes an outwardly projecting generally cylindrical support hub, and a generally U-shaped bracket having means surrounding and supporting said hubs for rotatable adjustment of said fixture on the axis of said hubs.

10. A light fixture as defined in claim 1 and including at least one end reflector panel of sheet material, means for securing an edge portion of said end reflector panel to one of said end closure members, and the remaining portion of said end reflector panel projects outwardly in a cantilevered manner from one end closure member and into said U-shaped reflector panel.

11. A light fixture as defined in claim 1 wherein said lamp element includes an outer curved end surface positioned generally adjacent one of said end closure members, cup means engaging said outer end surface of said lamp element, a spring biased metal plunger mounted on said one end closure member and supporting said cup means for conducting heat from said lamp element to said one end closure member.

12. A method of producing a light fixture adapted for use in an environment of high moisture and/or high dust particles, comprising the steps of bending a flexible sheet reflector panel to form a generally U-shaped inner reflecting surface, inserting said reflector panel axially into a light transmitting rigid tube having a center axis, securing a set of end closure members to opposite end portions of said tube, and supporting with one of said end closure members an elongated lamp element with its axis spaced substantially parallel with and eccentrically between the center axis of said tube and said reflector panel.

13. A method as defined in claim 12 and including the step of bending at least one edge portion of said reflector panel outwardly from said inner reflecting surface for precisely positioning said reflecting surface relative to said lamp element.

14. A method as defined in claim 12 and including the steps of forming at least one end reflector element from sheet metal, mounting said end reflector element on one of said end closure members, and positioning said end reflector element with a portion projecting axially inwardly from said one end closure member into said tube and into said sheet reflector panel.

15. A method as defined in claim 12 including the steps of forming an outwardly projecting hollow support hub on each of said end closure members eccentrically of said center axis, positioning a lamp socket member within one of said hubs for supporting said lamp element, and supporting said light fixture with bracket means surrounding and engaging said support hubs.

* * * * *